United States Patent [19]

Kukes et al.

[11] Patent Number: 4,659,453

[45] Date of Patent: Apr. 21, 1987

[54] HYDROVISBREAKING OF OILS

[75] Inventors: Simon G. Kukes; Jerald A. Howell, both of Bartlesville, Okla.

[73] Assignee: Phillips Petroleum Company, Bartlesville, Okla.

[21] Appl. No.: 826,406

[22] Filed: Feb. 5, 1986

[51] Int. Cl.[4] ..... C10G 45/04

[52] U.S. Cl. ..... 208/108; 208/112; 208/107; 502/220

[58] Field of Search ..... 208/57, 68, 108, 112, 208/215, 216 R, 251 H; 502/220, 221

[56] References Cited

U.S. PATENT DOCUMENTS

| | | | |
|---|---|---|---|
| 3,022,499 | 11/1961 | Stine | 208/108 |
| 3,161,585 | 12/1964 | Gleim et al. | 208/264 |
| 3,331,769 | 7/1967 | Gatsis | 208/210 |
| 3,617,503 | 11/1971 | Rogers | 208/112 X |
| 3,619,410 | 11/1971 | Gleim | 208/108 |
| 3,729,407 | 4/1973 | Camp et al. | 208/112 X |
| 3,764,649 | 10/1973 | Kurtak et al. | 423/517 |
| 3,785,958 | 1/1974 | Gleim et al. | 208/87 |
| 3,876,755 | 4/1975 | Kurtak et al. | 423/517 |
| 3,901,796 | 9/1976 | Hilfman | 208/112 X |
| 4,104,152 | 8/1978 | Hilfman | 208/112 |
| 4,243,553 | 1/1981 | Naumann et al. | 252/439 |
| 4,244,839 | 1/1981 | Aldridge et al. | 252/431 |
| 4,285,804 | 8/1981 | Jacquin et al. | 208/48 R |
| 4,357,229 | 11/1982 | Bearden, Jr. et al. | 208/10 |
| 4,389,301 | 6/1983 | Dahlberg et al. | 208/59 |
| 4,430,442 | 2/1984 | Sawyer et al. | 502/220 |
| 4,540,481 | 9/1985 | Sawyer et al. | 208/215 |
| 4,542,121 | 9/1985 | Mitchell et al. | 502/220 |
| 4,557,821 | 12/1985 | Lopez et al. | 208/108 X |

OTHER PUBLICATIONS

"A Comprehensive Treatise on Inorganic and Theoretical Chemistry", vol XI, by Mellor; Longmans, Green & Co.; 1931, pp. 650–656.

J. Inorg. Nucl. Chem., 1973, vol. 35, pp. 1895–1904, article by T. P. Prasad et al.

"Novel Catalyst and Process for Upgrading Residua . . . ", by R. Bearden et al., AIChE 90th Nat. Meetg., Apr. 1981.

*Primary Examiner*—Glenn Caldarola

*Attorney, Agent, or Firm*—K. K. Brandes

[57] ABSTRACT

A hydrotreating (hydrovisbreaking) process comprises the step of contacting under suitable conditions (A) a substantially liquid hydrocarbon-containing feed stream containing more than 0.1 weight-% Ramsbottom carbon residue, (B) a hydrogen-containing gas and (C) a liquid catalyst composition, which has been prepared by mixing (a) water, (b) at least one alkali metal sulfide or hydrogen sulfide or ammonium sulfide or hydrogen sulfide and (c) at least one molybdenum-oxygen compound, wherein the atomic ratio of S:Mo in this liquid catalyst composition is in the range of from about 0.6:1 to about 3.0:1, preferably from about 0.8:1 to 2.3:1. Preferably, (b) is $(NH_4)_2S$ and (c) is $MoO_3$.

17 Claims, 1 Drawing Figure

HYDROVISBREAKING OF OILS

BACKGROUND OF THE INVENTION

In one aspect, this invention relates to a process for hydrovisbreaking liquid hydrocarbon-containing feed streams so as to produce lower boiling hydrocarbons. In another aspect, this invention relates to the use of a new inorganic molybdenum and sulfur containing catalyst composition in a hydrovisbreaking process so as to minimize coke formation.

It is well known to hydrotreat (hydrofine) liquid hydrocarbon-containing feed streams such as heavy oils, which contain undesirable metal and sulfur compounds as impurities and also considerable amounts of cokable materials (referred to as Ramsbottom carbon residue), so as to convert them to lower boiling materials having lower molecular weight than the feed hydrocarbons and to remove at least a portion of metal and sulfur impurities and cokable materials. A specific type of hydrotreating process is heat-soaking, preferably with agitation, in the presence of hydrogen but preferably in the absence of a fixed catalyst bed, hereinafter referred to as hydrovisbreaking.

One of the operational problems of such hydrovisbreaking processes is the formation of undesirably high amounts of coke, which represent losses in hydrocarbonaceous materials and also may necessitate a costly separation step. Therefore, there is an ever present need to develop new oil hydrotreating processes utilizing efficient hydrotreating agents designed to reduce coke formation.

SUMMARY OF THE INVENTION

It is an object of this invention to provide a process for hydrotreating substantially liquid hydrocarbon-containing feed streams wherein coke formation is minimized. It is another object of this invention to employ a novel hydrotreating catalyst composition, which contains molybdenum and sulfur, in a hydrotreating process. It is a further object of this invention to provide a process for hydrovisbreaking heavy oils that contain Ramsbottom carbon residue. Other objects and advantages will be approved from the detailed description and the appended claims.

In accordance with this invention, a process for hydrotreating hydrocarbon feed streams comprises the step of contacting (A) a substantially liquid hydrocarbon-containing feed stream, which also contains Ramsbottom carbon residue in excess of about 0.1 weight-%, simultaneously with (B) a free hydrogen-containing gas, and (C) a substantially liquid catalyst composition prepared by mixing (a) liquid water, (b) at least one sulfide selected from the group consisting of alkali metal sulides, alkali metal hydrogen sulfides, ammonium sulfide and ammonium hydrogen sulfide, and (c) at least one molybdenum and oxygen containing compound, wherein the amounts of (a), (b) and (c) are such that a substantially clear solution is obtained and the atomic ratio of S:Mo in said catalyst composition (C) is in the range of from about 0.6:1 to about 3.0:1;

wherein said contacting is carried out under such conditions and in such amounts of (A), (B) and (C) as to obtain a liquid product having reduced amounts of Ramsbottom carbon residue and reduced amounts of hydrocarbons boiling in excess of 1000° F. (at atmospheric pressure).

Preferably, (b) is $(NH_4)_2S$ and (c) is $MoO_3$. Also preferably, the atomic S:Mo ratio in the catalyst composition (C) is in the range of from about 0.8:1 to about 2.3:1. Also, preferably, the contacting of the hydrocarbon feed streams with the hydrogen-containing gas and the catalyst composition is carried out by heating with agitation, in the substantial absence of a solid hydrofining catalyst. The preferred hydrocarbon feed stream has more than about 1 weight-% Ramsbottom carbon residue.

Use of substantially liquid catalyst composition (C) in the hydrotreating process of this invention results in less coke formation than hydrotreating with no additive or with molybdenum catalyst compositions prepared at S:Mo atomic ratios outside the range of this invention.

DETAILED DESCRIPTION OF THE INVENTION

Figure 1:
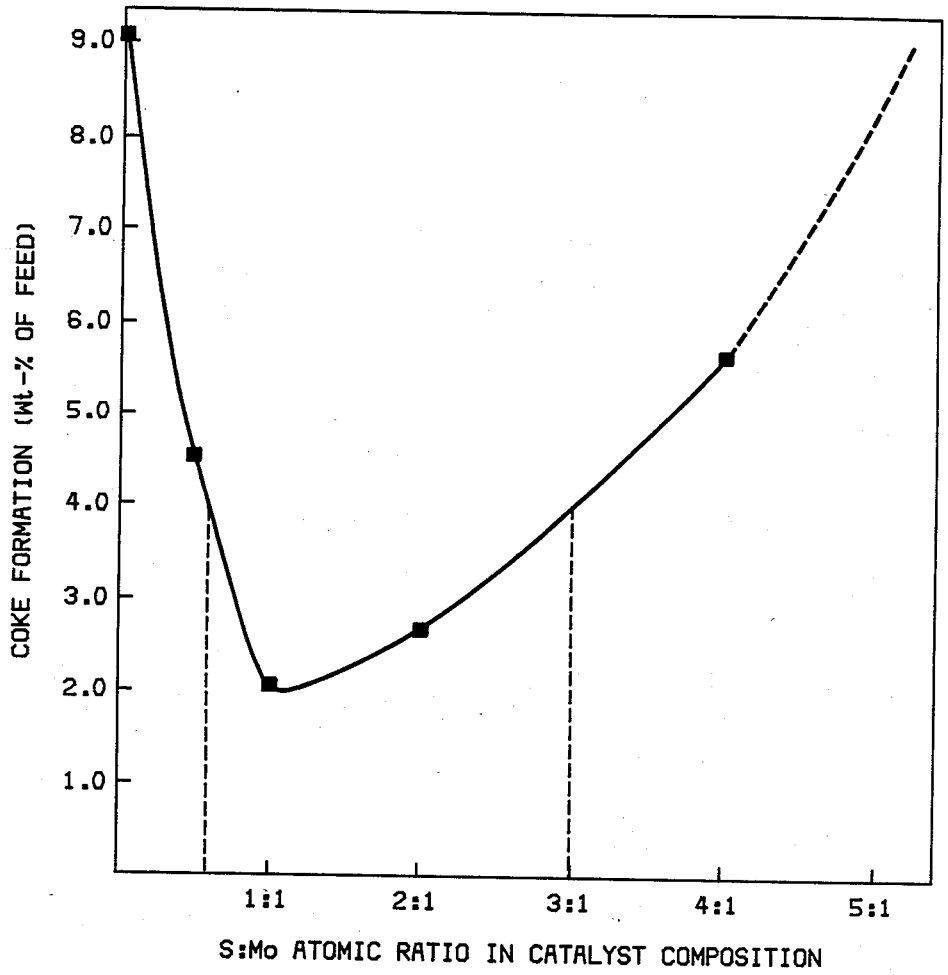
FIG. 1 shows a graphic correlation between coke formation in a hydrovisbreaking process and the atomic S:Mo ratio in a catalyst composition employed in said process.

Any hydrocarbon-containing feed stream that is substantially liquid at the contacting conditions of the process of this invention and contains Ramsbottom carbon residue in excess of about 0.1 weight-% (determined according to ASTM D-524) can be processed using the above-described catalyst composition in accordance with the present invention. Suitable hydrocarbon-containing feed streams include crude oil, petroleum products, coal pyrolyzates, products from extraction and/or liquefaction of coal and lignite, products from tar sands, shale oil, products from shale oil and similar products. Preferred hydrocarbon feed streams include full range (untopped) crudes, topped crudes having a boiling range in excess of about 343° C. and residua. The present invention is particularly directed to heavy feed streams such as heavy full range crudes, heavy topped crudes and residua and other materials which are generally regarded as too heavy to be distilled. These materials will generally contain the highest concentrations of Ramsbottom carbon residue, metals (Ni, V), sulfur and nitrogen.

Preferably the Ramsbottom carbon residue content of the hydrocarbon feed stream exceeds about 1 weight-% and more preferably is in the range of about 2–30 weight-%.

Preferably, the hydrocarbon-containing feed steam also contains about 3–500 ppmw nickel (parts by weight of Ni per million parts by weight of feed), about 5–1000 ppmw vanadium, about 0.2–6 weight-% sulfur, about 0.1–3 weight-% nitrogen and 1–99 weight-% of materials boiling in excess of about 1000° F. under atmospheric pressure conditions. Preferably the $API^{60}$ gravity of the feed is in the range of from about 4 to about 30.

The free hydrogen containing gas used in the hydrotreating process of this invention can be substantially pure hydrogen gas, or can be mixtures of hydrogen with other gases such as nitrogen, helium, methane, ethane, carbon monoxide or hydrogen sulfide. At present, substantially pure hydrogen gas is preferred.

The catalyst composition (C) employed in the process of this invention can be prepared in any manner and in any apparatus which affords mixing of (a) water, (b) at least one alkali metal sulfide or ammonium sulfide or at least one alkali metal hydrogen sulfide or ammonium hydrogen sulfide or mixtures thereof, and (c) at least one compound that contains chemically bound Mo and O, in any order and in such amounts that a substantially clear solution is obtained and the S:Mo atomic ratio in the catalyst composition is in the range of from about 0.6:1 to about 3.0:1, preferably from about 0.8:1 to about 2.3:1. Generally the amount of water in the substantially liquid catalyst composition (C) is in the range of from about 85 to about 98 weight percent, preferably from about 90 to about 95 weight percent.

Generally the mixing is carried out with agitation at room temperature. It is believed that at least a portion of ingredients (b) and (c) are converted to thiomolybdates wherein at least a portion of oxygen in (c) is replaced by sulfur. Even though it is preferred to make a clear solution, it is within the scope of this invention to obtain a solution having small amounts of solid particles dispersed therein. In this case, the solution plus dispersed particles can be used as is in the hydrotreating process of this invention; or the dispersed solid particles can be separated from the solution by any suitable separation technique such as filtration, centrifugation, or settling and subsequent draining.

Examples of sulfide compound (b) and $Li_2S$, LiHS, $Na_2S$, NaHS, $Rb_2S$, RbHS, $Cs_2S$, CsHS, $(NH_4)_2S$, $NH_4HS$, and mixtures thereof. The presently preferred sulfide (b) is $(NH_4)_2S$, which may be in a hydrated form.

Molybdenum and oxygen containing compounds that can be employed as reagent (c) in the preparation of catalyst composition (C) include molybdenum oxides, molybdenum blue, molybdic acids, ammonium and alkali metal orthomolybdates, ammonium and alkali metal dimolybdates, ammonium and alkali metal heptamolybdates, ammonium and alkaki metal isomolybdates, phosphomolybdic acid and ammonium salts thereof, and the like, and mixtures thereof. Presently preferred is $MoO_3$, which may contain some chemically bound water.

Any suitable quantity of the free hydrogen containing gas can be employed in the process of this invention. The quantity of hydrogen gas used to contact the hydrocarbon-containing feedstock, either in a continuous or in a batch process, will generally be in the range of about 100 to about 20,000 standard cubic feet (SCF) $H_2$ per barrel of the hydrocarbon-containing feed and will more preferably by in the range of about 500 to about 5,000 standard cubic feet $H_2$ per barrel of the hydrocarbon-containing feed stream.

Any suitable amount of the substantially liquid catalyst composition (C) can be employed. The amount of the catalyst composition to the hydrocarbon feed will generally be such as to provide a concentration of about 1–2000, more preferably about 5–500 ppmw, of molybdenum (calculated as element) in the feed stream.

The hydrotreating process of this invention can be carried out by means of any suitable apparatus whereby there is achieved an intimate contact of the hydrocarbon-containing feed stream, the free hydrogen-containing gas and the substantially liquid Mo-S-containing catalyst composition (C), under such hydrotreating (hydrovisbreaking) conditions as to produce a liquid hydrocarbon-containing product having lower Ramsbottom carbon residue than the feed stream. Generally, this hydrovisbreaking process also reduces the amount of undesirable materials boiling in excess of 1000° F. (at 1 atm) and the amounts of nickel, vanadium, sulfur and nitrogen compounds contained as impurities in the hydrocarbon-containing feed stream. The hydrovisbreaking process can be carried out as a continuous process or as a batch process.

The hydrovisbreaking process of this invention is in no way limited to the use of any particular type of process or apparatus. The term "feed stream" refers to both continuous and batch process. In a continuous operation, it is preferred to premix the hydrocarbon feed stream with the liquid catalyst composition, e.g., in a vessel equipped with a mechanical stirrer, or in a static mixer, or by means of a recirculating pump. This mixture of (A) and (C) is then passed concurrently with a stream of free hydrogen-containing gas into the bottom portion of a reactor, which is preferably equipped with heating means and also mechanical agitating or static mixing means so as to provide intimate contact of the process ingredients (A), (B) and (C) at elevated temperatures. The products generally exit through outlets located in the top portion of the reactor. In a batch operation, (A) and (C) can also be premixed and charged to a reactor equipped with heating means and agitating a static mixing means. The reactor is then generally pressured with hydrogen gas. However, it is within the scope of this invention to introduce process ingredients (A), (B) and (C) simultaneously, or sequentially in any order, to the reactor.

It is within the scope of this invention to have solid materials present, either umpromoted refractory oxides or phosphates (e.g., $Al_2O_3$, $SiO_2$, $AlPO_4$ and the like) or promoted hydrofining catalysts (e.g., $Ni/Mo/Al_2O_3$ or $Co/Mo/Al_2O_3$). However, it is presently preferred to substantially exclude such solid materials during the hydrotreating process of this invention.

Any suitable reaction time in the hydrovisbreaking process of this invention can be utilized. In general, the reaction time (i.e., the time of contact between (A), (B) and (C)) will range from about 0.01 hours to about 20 hours. Preferably, the reaction time will range from about 0.1 to about 5 hours and more preferably from about 0.25 to about 3 hours. Thus, for a continuous process, the flow rate of the hydrocarbon containing feed stream should be such that the time required for the passage of the mixture through the reactor (residence time) will preferably be in the range of about 0.1 to about 5 hours and more preferably about 0.25 to about 3 hours. For a batch process, the hydrocarbon containing feed stream will preferably remain in the reactor for a time in the range of about 0.1 hours to about 5 hours and more preferably from about 0.25 hours to about 3 hours.

The hydrovisbreaking process of this invention can be carried out at any suitable temperature. The temperature will generally be in the range of about 250° C. to about 550° C. and will preferably be in the range of about 380° to about 480° C. Higher temperatures do improve the removal of impurities but such temperatures may have adverse effects on coke formation. Also, economic consideration will have to be taken into consideration in the selection of the reaction temperature.

Any suitable pressure can be utilized in the hydrovisbreaking process of this invention. The reaction pressure will generally be in the range of about atmospheric (0 psig) to about 10,000 psig. Preferably, the pressure will be in the range of about 500 to about 3,000 psig. Higher hydrogen pressures tend to reduce coke formation but operation at high pressure may have adverse economic consequences.

The gaseous, liquid and solid products of the hydrofining (hydrovisbreaking) process of this invention can be withdrawn from the contacting reactor and separated from each other by any conventional separating means. Also, the fractionation of the liquid hydrocarbon product having reduced Ramsbottom carbon residue into fractions boiling in different temperature ranges can be carried out by any conventional distillation means, either under atmospheric or vacuum conditions.

Preferably, at least a portion of the liquid hydrocarbon-containing effluent from the hydrovisbreaking reactor is first treated in at least one additional hydrotreating process, more preferably carried out in a fixed bed reactor containing a suitable solid hydrofining catalysts (such as $Co/Mo/Al_2O_3$ or $Ni/Mo/Al_2O_3$) so as to reduce the amounts of remaining impurities (Ni, V, S, N, coke precursors) in the liquid, and is then treated in a catalytic cracking process (e.g., a FCC process employing clay- or zeolite-containing catalysts) under such conditions so as to produce gasoline, distillate fuels and other useful products. It is, however, within the scope of this invention to catalytically crack (e.g., in the presence of zeolite or clay catalysts) at least a portion of said liquid hydrovisbroken product (effluent) without such an additional prior hydrotreating process employing solid hydrofining catalysts.

The following examples are presented in further illustration of the invention.

EXAMPLE I

In this example the experimental setup for batch-type hydrovisbreaking of heavy oils is described. About 100 grams of a topped (950° F.+) Hondo heavy crude (containing 18.2 weight-% Ramsbottom C, 6.2 weight-% S, 730 ppm (V+Ni), 0.55 weight-% xylene insolubles and a 1000° F.+ fraction of 85.1 weight-%) plus appropriate amounts of various molybdenum containing catalyst compositions were added to a 300 cc stirred autoclave (Autoclave Engineers, Inc., Erie, PA), which was preheated to about 200° F. The unit was sealed, alternately pressured with $H_2$ and vented so as to eliminate air, and finally pressured with $H_2$ to the desired starting pressure (about 1400 psig). Stirring at about 1000 r.p.m. and rapid heating up to the test temperature about 800° F. was carried out. During the test run, hydrogen gas was added so as to maintain a constant pressure of about 2000 psig at the final test temperature.

After heating at about 800° F. for about 60 minutes, the unit was cooled as quickly as possible, depressured and opened. The liquid product was collected and analyzed. Primarily, the amount of dispersed coke particles (collected by filtration through a 0.45 μm membrane filter and weighing) and the amount of the fraction boiling above 1000° F. was determined.

EXAMPLE II

This example illustrates the preparation of a liquid molybdenum and sulfur-containing catalyst composition within the scope of this invention. An aqueous solution containing 42.1 weight-% $(NH_4)_2S$ (provided by Chemical Products Corporation, Carterville, Ga.) was filtered so as to remove suspended dark particles. The filtered liquid had a yellow color of less than 1.5 (determined by ASTM D-1500).

3.4 grams of this filtered $(NH_4)_2S$ solution containing 0.02105 moles of $(NH_4)_2S$ were mixed with 95.3 grams of distilled water. Then 1.5 grams (0.01042 mole) of $MoO_3$ (provided by Mallinckrodt, Inc., St. Louis, Mo.) were added. The mixture was stirred for several minutes until an orange-colored solution (ASTM D-1500 color <3.5) was obtained. This catalyst composition (total weight: 100 g) thus had an atomic S:Mo ratio of 2:1.

Several other liquid catalyst compositions (also weighing 100 grams) were prepared essentially in accordance with the above-described procedures, with the exception that the amounts of $(NH_4)_2S$ were varied so as to provide compositions of different S:Mo atomic ratios. The amount of $MoO_3$ was always 1.5 grams; the amount of distilled water added was the difference between 100 and the combined weight of $MoO_3$ and 42.1 weight-% aqueous $(NH_4)_2S$.

EXAMPLE III

This example illustrates the results of hydrovisbreaking tests in accordance with the procedure outlined in Example I employing the liquid Mo-S-containing catalyst compositions described in Example II. Also tested in control runs were $MoO_3$ and $MoS_2$. Test results are summarized in Table 1.

TABLE I

| | Run | | | | | | |
|---|---|---|---|---|---|---|---|
| | 1 (Control) | 2 (Control) | 3 (Invention) | 4 (Invention) | 5 (Control) | 6 (Control) | 7 (Control) |
| Catalyst | $MoO_3$ | $(NH_4)_2S$ + $MoO_3$ | $(NH_4)_2S$ + $MoO_3$ | $(NH_4)_2S$ + $MoO_3$ | $(NH_4)_2S$ + $MoO_3$ | $(NH_4)_2S$ + $MoO_3$ | $MoS_2$ |
| S:Mo Atomic Ratio | 0:1 | 0.5:1 | 1:1 | 2:1 | 4:1 | 6:1 | 2:1 |
| ppm Mo Added to Feed | 100 | 100 | 100 | 100 | 100 | 100 | 100 |
| Coke Formation (Wt. % of Feed | 10.6 | 4.5 | 2.1 | 2.7 | 5.7 | —[2] | —[2] |
| 1000° F. + Conversion (Wt. %) | 75.2 | —[3] | 61.3 | 67.1 | 71.7 | —[2] | —[2] |

[1]average of 4 runs
[2]test could not be completed due to overpressure (caused by excessive cracking and generation of gases)
[3]not measured
[4]Note: When a slurry of $MoO_3$ and $NH_3$ (mole ratio: 1:0.5) was used in lieu of $MoO_3$ in a test similar to run 1, coke formation was 9.1 (wt. % of feed).

The test results are illustrated in FIG. 1, in which coke formation is plotted versus Mo:S atomic ratio. The graph in FIG. 1 clearly shows that coke formation was acceptably low (4 wt-% or less at the test conditions) only when the S:Mo atomic ratio of the liquid catalyst composition of this invention (prepared from $(NH_4)_2S$, $MoO_3$ and $H_2O$) was in the range of from about 0.6 to about 3.0. The preferred Mo:S atomic range was about 0.8–2.3 (resulting in coke formation of 3 weight-% or less at the test conditions). $MoS_2$ was not a suitable catalyst (in spite of its 2:1 atomic ratio of Mo to S) because it caused excessive cracking and gas formation.

Reasonable variations and modification are possible within the scope of the disclosure and the appended claims to the invention.

We claim:

1. A process for hydrotreating hydrocarbon-containing feed streams comprising the step of contacting:

(A) a substantially liquid hydrocarbon-containing feed stream, which also contains Ramsbottom carbon residue in excess of about 0.1 weight-%, simultaneously with (B) a free hydrogen-containing gas, and (C) a substantially liquid catalyst composition prepared by mixing (a) liquid water, (b) ammonium sulfide and (c) at least one molybdenum and oxygen containing compound, wherein the amounts of (a), (b) and (c) are such that a substantially clear solution is obtained and the atomic ratio of S:Mo in composition (C) is in the range of from about 0.6:1 to about 3.0:1;

wherein said contacting is carried out under such conditions and with such amounts of (A), (B) and (C) as to obtain a liquid hydrocarbon-containing product having reduced amounts of Ramsbottom carbon residue and reduced amounts of hydrocarbons boiling in excess of 1000° F.

2. A process in accordance with claim 1 wherein said substantially liquid hydrocarbon containing feed stream contains Ramsbottom carbon residue in excess of about 1 weight-%.

3. A process in accordance with claim 1 wherein said substantially liquid hydrocarbon containing feed stream contains about 2–30 weight-% Ramsbottom carbon residue.

4. A process in accordance with claim 3 wherein said hydrocarbon-containing feed stream further contains about 3–500 ppmw nickel, about 5–1000 ppmw vanadium and about 1–99 weight-% of materials boiling in excess of about 1000° F. under atmospheric pressure conditions.

5. A process in accordance with claim 1 wherein said at least one molybdenum and oxygen containing compound is selected from the group consisting of molybdenum oxides, molybdenum blue, molybdic acids, ammonium orthomolybdates, alkali metal orthomolybdates, ammonium dimolybdates, alkali metal dimolybdates, ammonium heptamolybdates, alkali metal heptamolybdates, ammonium isomolybdates, alkali metal isomolybdates, phosphomolybdic acid, ammonium salts of phosphomolybdic acids, and mixtures thereof.

6. A process in accordance with claim 5 wherein said molybdenum and oxygen containing compound is $MoO_3$.

7. A process in accordance with claim 1 wherein the atomic ratio of S:Mo in composition (C) is in the range from of about 0.8:1 to about 2.3:1.

8. A process in accordance with claim 1 wherein said contacting conditions comprise a hydrogen addition in the range of from about 100 to about 20,000 standard cubic feet of $H_2$ per barrel of hydrocarbon-containing feed, a time of contact between (A), (B) and (C) in the range of from about 0.01 to about 20 hours, a reaction temperature in the range of from about 250° to about 550° C. and a reaction pressure in the range of from about 0 psig to about 10,000 psig.

9. A process in accordance with claim 1 wherein said contacting conditions comprise a hydrogen addition in the range of from about 500 to about 5,000 standard cubic feet of $H_2$ per barrel of hydrocarbon-containing feed, a time of contact between (A), (B) and (C) in the range of from about 0.1 to about 5 hours, a reaction temperature in the range of from about 380° to about 480° F. and a reaction pressure in the range of from about 500 psig to about 3,000 psig.

10. A process in accordance with claim 1 wherein the amount of (C) is such that the molybdenum concentration during said contacting is about 1–2,000 ppmw Mo in said hydrocarbon-containing feed stream.

11. A process in accordance with claim 1 wherein the amount of (C) is such that the molybdenum concentration during said contacting is about 5–500 ppmw Mo in said hydrocarbon-containing feed stream.

12. A process in accordance with claim 1 comprising the additional step of withdrawing gaseous, liquid and solid products from a reactor in which said contacting is carried out.

13. A process in accordance with claim 12 comprising the additional step of separating said gaseous, liquid and solid products from each other.

14. A process in accordance with claim 13 comprising the additional step of catalytically cracking at least a portion of said separated liquid products under such conditions as to produce gasoline, distillate fuels and other useful products.

15. A process in accordance with claim 13 wherein at least a portion of said separated liquid products is hydrotreated in the present of a solid hydrofining catalyst so as to reduce the amounts of remaining impurities in said liquid product.

16. A process in accordance with claim 15 wherein at least a portion of said hydrotreated liquid products is catalytically cracked under such conditions as to produce gasoline, distillate fuels and other useful products.

17. A process in accordance with claim 1, wherein said atomic ratio of S:Mo in composition (C) is about 1:1.

* * * * *